United States Patent [19]

Levesque

[11] 3,950,219

[45] *Apr. 13, 1976

[54] METHOD OF MANUFACTURING A STABILIZED FLUFFY BATT OF FIBERS AND PRODUCTS RESULTING THEREFROM

[75] Inventor: Yvon George Levesque, Montreal, Canada

[73] Assignee: Johnson & Johnson, New Brunswick, N.J.

[ * ] Notice: The portion of the term of this patent subsequent to Apr. 13, 1993, has been disclaimed.

[22] Filed: Jan. 7, 1974

[21] Appl. No.: 431,534

[52] U.S. Cl. ..... 162/201; 162/183; 162/184; 264/121

[51] Int. Cl.[2] ..... D21H 3/00

[58] Field of Search ..... 162/9, 100, 157 C, 169, 162/182, 183, 213, 201; 117/66, 120; 264/109, 121, 116, 126, 125, 123; 128/287, 284; 427/209, 331, 439

[56] References Cited

UNITED STATES PATENTS

| | | | |
|---|---|---|---|
| 2,288,072 | 6/1942 | Collins | 264/116 |
| 2,671,496 | 3/1954 | Chavannes et al. | 264/116 |
| 2,744,045 | 5/1956 | Collins | 264/116 |
| 2,913,356 | 3/1959 | Shroeder | 162/157 C |
| 3,264,171 | 8/1966 | Gleason | 162/183 |
| 3,325,345 | 6/1967 | Hider | 162/183 |
| 3,677,886 | 7/1972 | Forssblad et al. | 162/182 |

OTHER PUBLICATIONS

Casey "Pulp & Paper" Vol. II, 2nd Ed., (1960), p. 947.

*Primary Examiner*—S. Leon Bashore
*Assistant Examiner*—Peter Chin

[57] ABSTRACT

A method of manufacturing a fluffy, lightweight batt of individualized fibers uniformly stabilized in its lofty state comprising applying to one surface of a dense batt of fibers a material capable of being activated to adhere adjacent fibers together. The treated dense batt is comminuted to individualize fibers and the fibers collected in the form of a batt. The batt is further treated to activate the material and stabilize the batt. The resulting product is a lightweight batt of individualized fibers which is stabilized uniformly throughout its depth.

8 Claims, 4 Drawing Figures

10
11
12
13
14
15
16
17
18
19
20
25
26
27
28
29
30

METHOD OF MANUFACTURING A STABILIZED FLUFFY BATT OF FIBERS AND PRODUCTS RESULTING THEREFROM

The present invention relates to a method of manufacturing stabilized batts of fibers and more particularly to a highly absorbent, lofty, stabilized wood pulp batt.

BACKGROUND OF THE INVENTION

For considerable time now absorbent batts made from fluffed wood pulp fibers have been used in sanitary napkins, disposable diapers, absorbent dressings and the like as a media which is highly absorbent and has considerable capacity for holding fluids. The batts are made from individualized wood pulp fibers which are used not only because of their highly absorbent properties but because of their softness and cost. In many instances the batts are wrapped with tissue or nonwoven fabric or the like to prevent linting of the fibers. In some products the surface of the batt may be stabilized by the addition of a binder to prevent linting and remove the necessity for using a cover or wrap for the batt.

A number of problems may be encountered when stabilizing the lightweight, fluffy, absorbent wood pulp batts. For example, when an adhesive binder is applied to the fibers after the batt is formed the binder is usually applied from a liquid carrier and the weight of the liquid will by itself compact the batt and greatly reduce its original loft. If binders are applied to an air slurry of fibers prior to the batt being formed it is extremely difficult to uniformly distribute the binder throughout the batt.

I have now discovered a process for manufacturing highly absorbent, lightweight, fluffy batts of wood pulp fibers which are uniformly stabilized throughout their depth and maintain excellent absorbing capacity and absorbing rate properties. My new process does not require the use of a liquid or aqueous media to stabilize the batt after the fluffy batt is formed and I am able to maintain excellent loft in the final product. Furthermore, in accordance with my new process I obtain uniform distribution of the binder materials and eliminate problems of migration of these materials.

SUMMARY OF THE PRESENT INVENTION

In accordance with the present invention a material is applied to a surface of wood pulp board. The material applied is subsequently treated to cause it to adhere wood pulp fibers together. The pulp board is treated so that the material does not extend throughout the entire depth of the board and it is critical that a portion of the fibers of the pulp board remain untreated. The treated pulp board is ground to individualize the fibers and uniformly distribute them in an air stream. Some of the fibers in the air stream will be untreated fibers while others of the fibers are coated with the material to some degree. The treated and untreated fibers are collected on a collecting means in the form of a lightweight fluffy batt of fibers having the material uniformly distributed throughout the batt. The batt is treated to either activate or reactivate the material and cause it to adhere adjacent fibers together and uniformly stabilize the lightweight, fluffy batt in situ.

DESCRIPTION OF THE DRAWINGS

The invention will be more readily understood by reference to the accompanying drawings wherein:

FIG. 3 is a perspective view of a stabilized fluffy wood pulp fiber batt of the present invention.

DETAILED DESCRIPTION OF THE INVENTION

Figure 1:
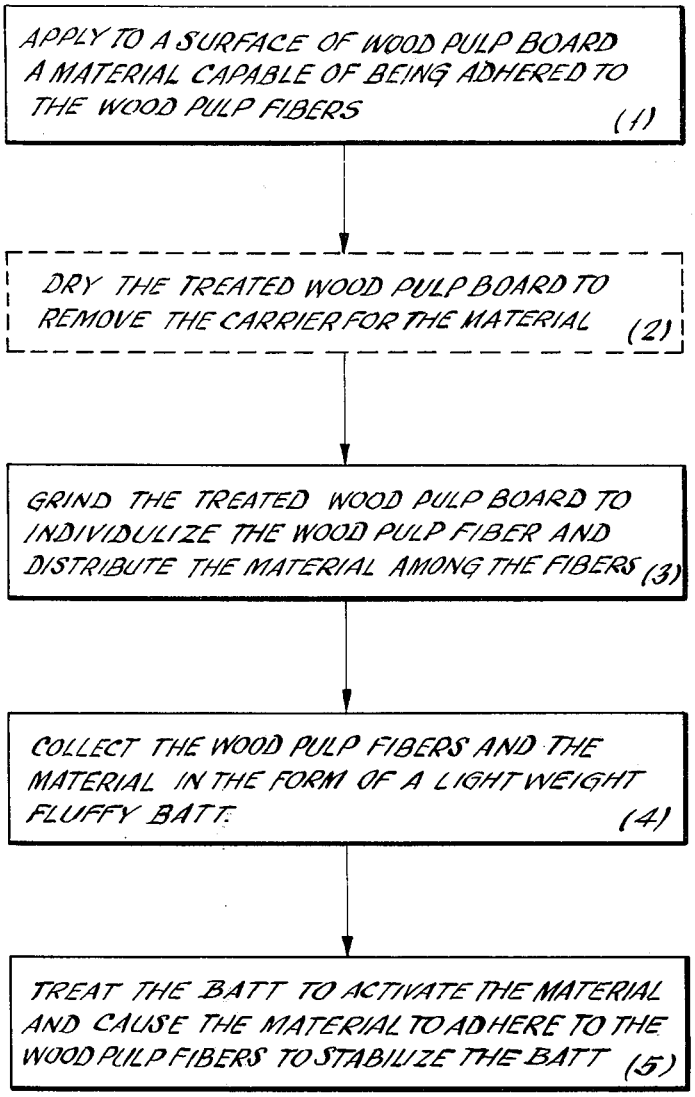
FIG. 1 is a process flow sheet for carrying out the method of the present invention.

Referring to the drawings in FIG. 1 there is shown a flow sheet for carrying out the method of the present invention. Wood pulp board which may be either a softwood pulp board or a hardwood pulp board has applied to one surface of the board a material which is capable of being treated so that it will adhere wood pulp fibers together (Box 1). Materials that could be applied could be either thermoplastic materials or thermosetting materials as desired. The material is applied to one surface so that it does not penetrate completely through the depth of the pulp board. If desired the material may be applied to both surfaces provided the center portion of the pulp board is left untreated. The treated pulp board may be dried (Box 2) to remove any carrier which is used to carry the material on to the pulp board. The treated wood pulp board is ground (Box 3) to comminute the board and individualize the fibers. The board may be ground by any of the standard grinding mechanisms such as counter-rotating toothed rollers, Bauer mills, Fitz mills, hammer mills or the like. The individualized fibers are carried in an air stream as an air slurry wherein the untreated fibers and the treated fibers become uniformly dispersed. The fibers are collected on a screen (Box 4) which catches the fibers and allows the air to pass through the screen so that a fluffy lightweight batt of wood pulp fibers having the material to be treated for adherence to the fibers uniformly distributed throughout the batt. The batt is treated to activate the material (Box 5); for example, if thermoplastic material has been used the batt may be treated to soften the material and adhere fibers together or if a thermosetting material is used a gaseous co-reactant medium may be passed through the batt to cross-link the thermosetting resin and adhere fibers together or similar techniques as are well-known to one skilled in the art. The resultant product is a stabilized fluffy, lightweight batt of wood pulp fibers. The batt has excellent loft and resiliency and does not lint or dust fibers during use. The batt may be used by itself as an absorbent product or it may be used in combination with nonwoven or paper facings and thermoplastic, water impermeable, film backings for such products as disposable diapers, sanitary napkins and the like.

Figures 2, 4, 5:
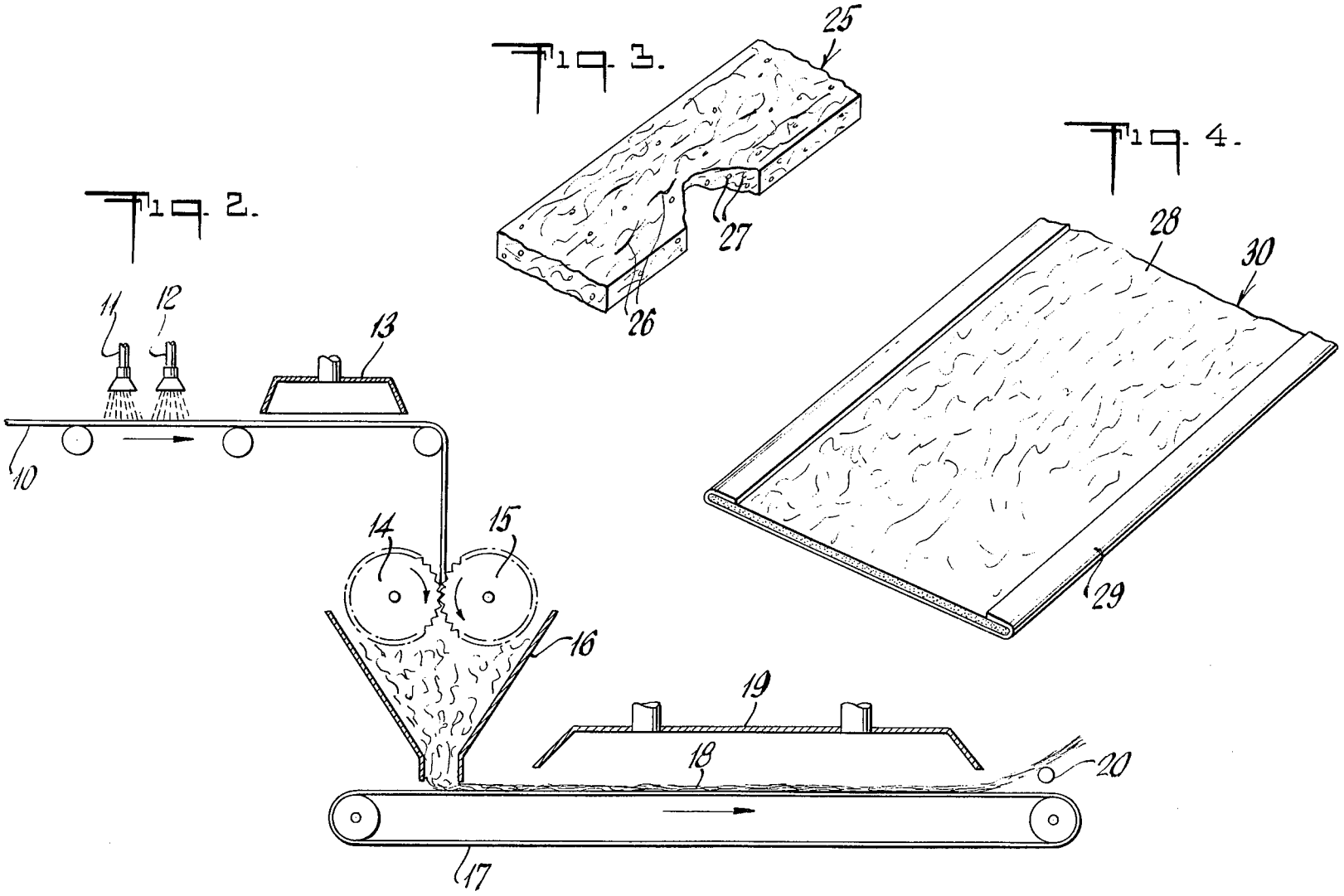
FIG. 2 is a schematic view of one form of apparatus for carrying out the method of the present invention into practice.
FIG. 4 is a view in perspective of a diaper which incorporates the fluffy wood pulp batt of the present invention.

In FIG. 2 there is schematically shown one form of apparatus for carrying the method of the present invention into practice. Pulp board 10 from a suitable supply is fed beneath spray nozzles 11 and 12 to spray onto the surface of the pulp board the desired stabilizing material. The board with the binder material thereon is passed under an oven 13 and the carrier for the binder driven off to form a relatively dry treated pulp board. The pulp board is fed to the nip of a pair of counter-rotating toothed rolls 14 and 15 which grind and comminute the wood pulp board and form individualized fibers. Some of the fibers have binder material thereon whereas other fibers are completely untreated. The fibers are dispersed in a volume of air and collected through a funnel 16 onto a moving permeable screen 17. The air passes through the screen and the fibers build up on the screen in the form of a fluffy batt 18. The fluffy batt of wood pulp fibers is passed through an oven 19 to supply heat or a circulating gas to activate the binder material or reactivate the binder material as the case may be and cause fibers to adhere together and stabilize the batt. The stabilized batt is removed from the conveyor by the pick-up roll 20 and may be wound up for further processing or may be fed directly to various converting processes.

In FIG. 3 there is shown a perspective view of a stabilized fluffy wood pulp batt made in accordance with the present invention. The batt 25 comprises wood pulp fibers 26 and uniformly distributed throughout the depth of the batt adhering the wood pulp fibers together is a binder material 27 as previously described.

In FIG. 4 there is shown a stabilized batt 28 of the present invention to which there has been laminated a water impermeable plastic film 29 to cover one surface of the batt and form the disposable diaper 30 shown.

Having thus generally described the invention reference will now be made to the accompanying examples illustrating preferred embodiments only.

EXAMPLE I

A hardwood pulp board in a highly compressed state 5 inches wide and 1/32 inch thick has applied to one surface a dispersion of polyethylene in water. The polyethylene is applied by spraying the surface so as to make up about 20 percent by weight of the batt. The polyethylene is allowed to set or dry and the treated board ground in a hammer mill to individualize fibers and particulate the polyethylene coating. The fibers and particulate polyethylene material are collected on a permeable screen in the form of a lightweight, fluffy batt of wood pulp fibers having uniformly distributed throughout the fibers small particles of polyethylene. The batt is heated to 150°C. for one minute to soften the polyethylene particles and adhere them to adjacent fibers to uniformly stabilize the entire batt of fibers without loss of loft and to provide good resiliency in the batt.

EXAMPLE II

Alpha M wood pulp board approximately 10 inches wide and 1/32 inch thick is sprayed on one surface with an uncured melamine-formaldehyde precondensate. The precondensate used is American Cyanamid's M-3 Resin with UTX catalyst and is applied so that the pulp board picks up about 10 percent by weight of the precondensate and has about 10 percent moisture content prior to grinding. The treated board is ground in a Bauer mill to comminute and individualize the wood pulp fibers and the treated wood pulp fibers. The fibers are collected on a screen in the form of a lightweight, fluffy batt of wood pulp fibers. The batt is heated to 150°C. for 1 minute to in situ cure the melamine-formaldehyde and form a cross-linked melamine-formaldehyde resin binder which uniformly stabilizes the batt throughout its entire depth without loss of loft of the batt.

EXAMPLE III

Alpha M wood pulp board approximately 10 inches wide and 1/32 inch thick is treated by spraying on one surface a diluted epoxy resin. The epoxy resin used is a two part slow cure epoxy sold by H. B. Fuller Canada Ltd. under the trademark FRAYMOR. The epoxy is sprayed on the surface so as to penetrate the board to about 25 percent of its thickness. The treated board is fed to the nip of a pair of counter-rotating toothed rolls and ground to individualize the wood pulp fibers and uniformly distribute the epoxy resin among the fibers. The individualized fibers are collected on a screen in the form of a lightweight batt of fibers weighing about 60 grams per square yard and having a density of about 0.05 grams per cubic centimeter. The fluffy batt is heated to 150°C. for 1 minute to cure the epoxy resin and adhere adjacent fibers together for form a stabilized, lofty, batt of fiber.

EXAMPLE IV

Alpha M wood pulp board approximately 10 inches wide and 1/32 inch thick is treated on one surface by spraying on a solution of sodium silicate. The solution used is 40 percent sodium silicate and is applied so that the pickup of the board is about 50 percent by weight. The board is partially dried to drive off the water. The board is fed to a Bauer mill to grind the board and individualize the fibers. The fibers are deposited in an air stream and collected in the form of a lightweight batt of wood pulp fibers having sodium silicate uniformly distributed throughout the entire thickness of the lightweight batt. The batt is exposed to hydrogen chloride fumes to convert the sodium silicate into a silica gel in situ throughout the depth of the batt and produce a highly absorbent, uniformly stabilized batt of wood pulp fibers.

EXAMPLE V

A hardwood pulp board in a highly compressed state, 5 inches wide and 1/32 inch thick has applied to one surface by a coating operation a polyvinyl chloride plastisol. About 60 percent by weight of the board of polyvinyl chloride plastisol is applied. The treated board is ground in a hammer mill to individualize fibers and grind the polyvinyl chloride. The ground board is collected on a permeable screen in the form of a lightweight, fluffy batt of wood pulp fibers having polyvinyl chloride plastisol uniformly distributed throughout the batt. The collected batt is cured at 130°C. for 1 minute to adhere fibers together and stabilize the batt without loss of loft and to provide good resiliency in the batt.

As will be evident from the above examples and prior description the processes of the present invention have many advantages over the prior art processes not only resulting in improved products but also by utilizing minimum amounts of binder materials for any given quantity of product compared to prior art procedures and further only a portion of the total fiber content of any given product need be treated. As such substantial economic savings can be obtained.

It will be understood that various modifications can be made to the above described preferred embodiments without departing from the spirit and scope of this invention.

What is claimed is:

1. A method of manufacturing a fluffy, light weight, uniformly stabilized batt of wood pulp fibers comprising; applying to a surface of wood pulp board a material capable of being activated to adhere adjacent wood pulp fibers together, said material penetrating through only a portion of the depth of said board in a sufficient amount to adhere the fibers together in the formed batt, grinding said treated wood pulp board to individualize and uniformly disperse the fibers and said material, collecting said individualized fibers and material in the form of a fluffy, light weight batt of wood pulp fibers having uniformly distributed throughout the batt said material and treating said batt to activate the material to cause adjacent fibers to adhere together and uniformly stabilize the batt.

2. A method according to claim 1 wherein the material applied to the surface of the pulp board is a thermoplastic material and the batt is treated to activate the thermoplastic material by heating the batt to a temperature of from 100°C. to 200°C.

3. A method according to claim 1 wherein the material applied to the pulp board is a cross-linkable thermosetting resin and the batt is treated to activate the resin by heating the batt to a temperature of from 20°C. to 250°C.

4. A method according to claim 1 wherein the wood pulp board is treated with polyethylene and the batt is treated to soften the polyethylene and adhere fibers together by heating the batt to a temperature of from 100°C. to 200°C.

5. A method according to claim 1 wherein an epoxy resin is sprayed on one surface of the pulp board and the batt is treated by heating to a temperature of from 20°C. to 250°C.

6. A method according to claim 1 wherein the batt of fibers and material is treated by heating the batt to a temperature above room temperature to activate the material and uniformly stabilize the batt.

7. A method according to claim 1 wherein the batt of wood pulp fibers and material is treated to activate the material and stabilize the batt by passing the batt through a gaseous atmosphere to activate the material and stabilize the batt.

8. A fluffy, lightweight, uniformly stabilized batt of wood pulp fibers produced in accordance with the method of claim 1.

* * * * *